US007713494B2

(12) United States Patent
Ichi et al.

(10) Patent No.: US 7,713,494 B2
(45) Date of Patent: May 11, 2010

(54) EXHAUST PURIFICATION DEVICE

(75) Inventors: Satoaki Ichi, Akashi (JP); Makoto Momosaki, Kakogawa (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 223 days.

(21) Appl. No.: 11/518,123

(22) Filed: Sep. 11, 2006

(65) Prior Publication Data

US 2007/0056275 A1 Mar. 15, 2007

(30) Foreign Application Priority Data

Sep. 15, 2005 (JP) ..... P2005-268821

(51) Int. Cl.
*B01D 50/00* (2006.01)

(52) U.S. Cl. ..... 422/180

(58) Field of Classification Search ..... 422/177, 422/179, 180

See application file for complete search history.

(56) References Cited

U.S. PATENT DOCUMENTS 4,118,198 A * 10/1978 Norback ..... 422/173
4,426,844 A * 1/1984 Nakano ..... 60/295
4,795,615 A * 1/1989 Cyron et al. ..... 422/179
6,550,573 B2 * 4/2003 Wagner et al. ..... 181/255
6,619,426 B2 * 9/2003 Minami et al. ..... 181/251

FOREIGN PATENT DOCUMENTS

JP 60-017220 1/1985

* cited by examiner

*Primary Examiner*—Tom Duong
(74) *Attorney, Agent, or Firm*—Wenderoth, Lind & Ponack, L.L.P.

(57) ABSTRACT

Disclosed is an exhaust purification device in which an entire length of an outer cylinder of a catalyst can be used effectively for exhaust purification and it is possible to prevent heat in fixing of the catalyst to an exhaust pipe from affecting a connection portion between the outer cylinder and catalyst main bodies. A catalyst includes an outer cylinder and a plurality of catalyst main bodies provided in the outer cylinder in a state of being spaced each other in a direction of an axial center of the outer cylinder. An outer face of the outer cylinder positioned between the catalyst main bodies is a fixed face to be fixed to an inside of the exhaust pipe.

19 Claims, 7 Drawing Sheets

EXHAUST PURIFICATION DEVICE

BACKGROUND OF THE INVENTION

1. Field of the Invention

The present invention relates to an exhaust purification device structured by providing a catalyst in an exhaust pipe of a vehicle or the like.

2. Description of the Related Art

In a vehicle such as a two-wheeled motor vehicle and a four-wheeled automobile, a catalyst is provided in an exhaust pipe in order to remove hydrocarbon (HC), nitrogen oxides (NOx), and the like included in exhaust gas. In Japanese Patent Application Laid-open No. 60-17220, there is disclosed a technique in which a catalyst is provided in a muffler of the exhaust pipe of the two-wheeled motor vehicle.

FIG. 8 is a sectional view showing an example of the exhaust pipe provided with the catalyst. The catalyst 100 includes an outer cylinder 102 and a catalyst main body 103 provided in the outer cylinder 102. The outer cylinder 102 is made of metal such as stainless steel. The catalyst main body 103 is formed by depositing catalyst metal on a surface of a honeycomb structure made of stainless steel or the like. The catalyst main body 103 is secured to an inner face of the outer cylinder 102 by brazing.

In fixing the catalyst 100 to the exhaust pipe 101, if an outer face of the outer cylinder 102 positioned on an outer periphery side of the catalyst main body 103 is subjected to welding, the brazed portion between the outer cylinder 102 and the catalyst main body 103 is susceptible to heat. Therefore, an end portion 102A of the outer cylinder 102 is caused to protrude from the catalyst main body 103 along a direction of an axial center O1 of the catalyst 100 and welding W5 is applied to this protruding portion, thereby preventing heat from affecting the brazed portion between the outer cylinder 102 and the catalyst main body 103.

However, if the end portion 102A of the outer cylinder 102 is caused to protrude from the catalyst main body 103, there is a useless area that does not contribute to purification of the exhaust gas in the outer cylinder 102. Therefore, this catalyst is inferior in purification performance to a catalyst in which a catalyst main body is provided throughout an inside of the outer cylinder 102 by an amount corresponding to the useless area.

SUMMARY OF THE INVENTION

The present invention addresses the above described condition, and an object of the present invention is to provide an exhaust purification device in which an entire length of an outer cylinder of a catalyst can be used effectively for exhaust purification and it is possible to prevent heat in fixing of the catalyst to an exhaust pipe from affecting the catalyst.

According to the invention, there is provided an exhaust purification device structured by providing a catalyst in an exhaust pipe, wherein the catalyst includes an outer cylinder and a plurality of catalyst main bodies provided in the outer cylinder in a state of being spaced from each other in an axial direction of the outer cylinder, and an outer face of the outer cylinder positioned between the plurality of catalyst main bodies is a fixed face to be fixed to an inside of the exhaust pipe.

As described above, if the plurality of catalyst main bodies are disposed spaced apart from each other in the outer cylinder, the exhaust gas which has passed through one of the catalyst main bodies is first mixed in the space between the catalyst main bodies and then passes through the other catalyst. Therefore, it is possible to uniformly purify the exhaust gas with the entire length of the catalyst main bodies. Therefore, the catalyst formed by providing the plurality of catalyst main bodies at intervals in the outer cylinder can exert substantially the same performance in spite of smaller amounts of catalyst main bodies as compared with a catalyst formed by providing one catalyst main body throughout an outer cylinder of the same length.

Therefore, in the present invention, the entire length of the outer cylinder can be utilized for purifying the exhaust gas and can exert substantially the same performance as the catalyst formed by providing one catalyst main body throughout the outer cylinder. Moreover, because the catalyst is fixed to the exhaust pipe through the fixed face positioned on the outer periphery side of the space between the plurality of catalyst main bodies, it is possible to prevent heat in fixing of the catalyst to the exhaust pipe from affecting a connection portion between the outer cylinder and the catalyst main bodies.

Preferably, a mounting bracket may be fixed to an inner face of the exhaust pipe and the fixed face may be fixed to the mounting bracket.

In accordance with this structure, a difference between a shape of the inner face of the exhaust pipe and a shape of the outer face of the catalyst can be accommodated by the mounting bracket, thereby properly fixing the catalyst irrespective of an inside shape of the exhaust pipe.

Preferably, the plurality of catalyst main bodies may have different axial lengths and the catalyst main body of the shorter axial length may be disposed at an upstream side of the longer catalyst main body in an exhaust gas flowing direction.

In accordance with this structure, because the exhaust gas of higher temperature circulates through the shorter catalyst main body, it is possible to further promote increase in temperature of the catalyst main body to activate the catalyst main body, thereby enhancing purification efficiency.

BRIEF DESCRIPTION OF THE DRAWINGS

These and other objects and features of the present invention will become more clear from the following description taken in conjunction with a preferred embodiment thereof with reference to the accompanying drawings.

DETAILED DESCRIPTION OF THE PREFERRED EMBODIMENTS

Figure 1:
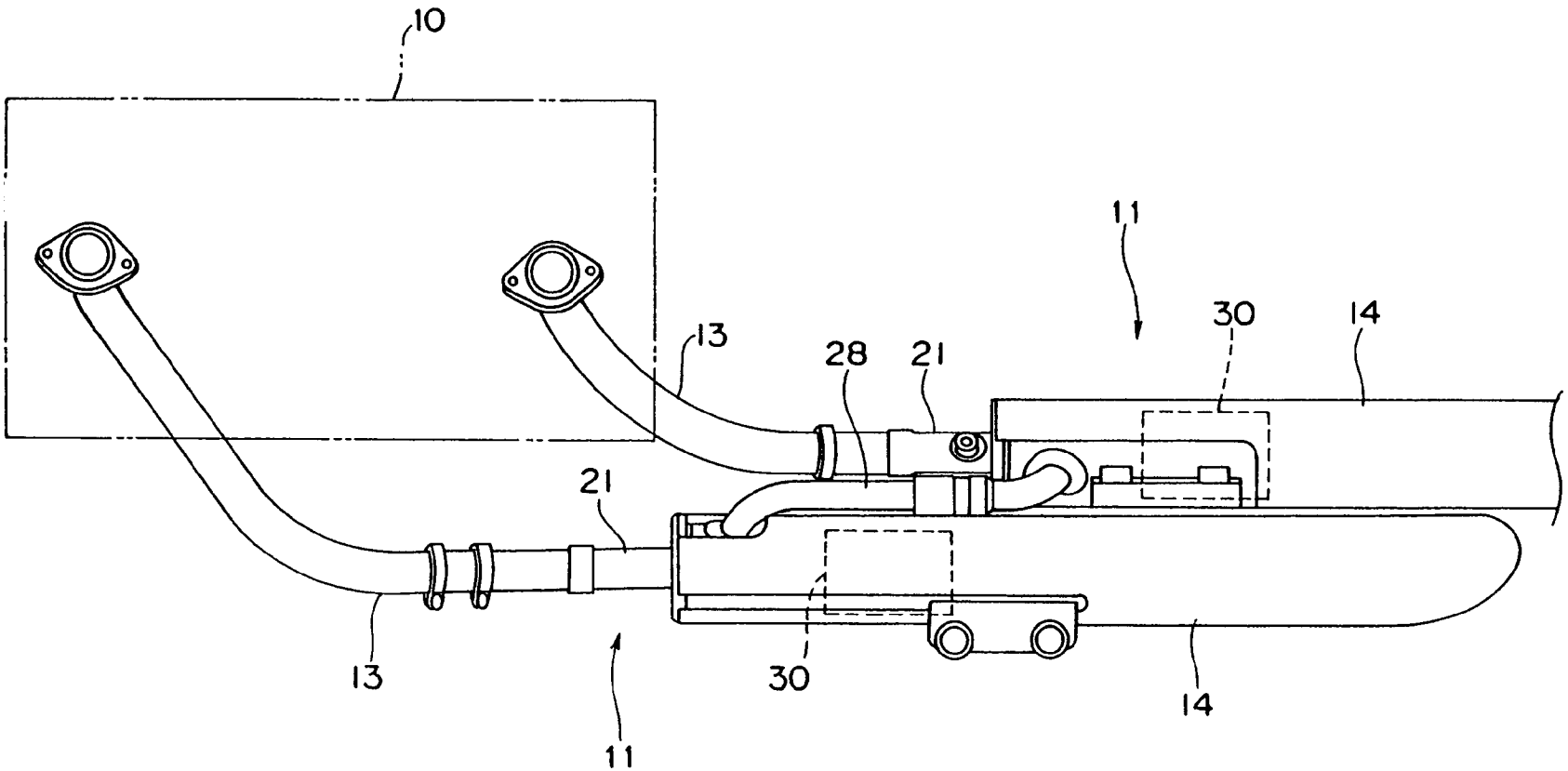
FIG. 1 is a plan view of exhaust pipes according to a first embodiment of the present invention.

FIG. 1 is a plan view of an exhaust purification device according to a first embodiment of the present invention. The exhaust purification device includes two exhaust pipes 11 and the exhaust pipes 11 are connected to respective cylinders of a V-type two-cylinder engine 10. Each of the exhaust pipes 11 includes a first pipe portion 13 with its front end connected to each of the cylinders of the engine and a second pipe portion 14 connected to a rear end of the first pipe portion 13. The second pipe portion 14 forms a muffler in which expansion chambers are formed.

Figure 2:
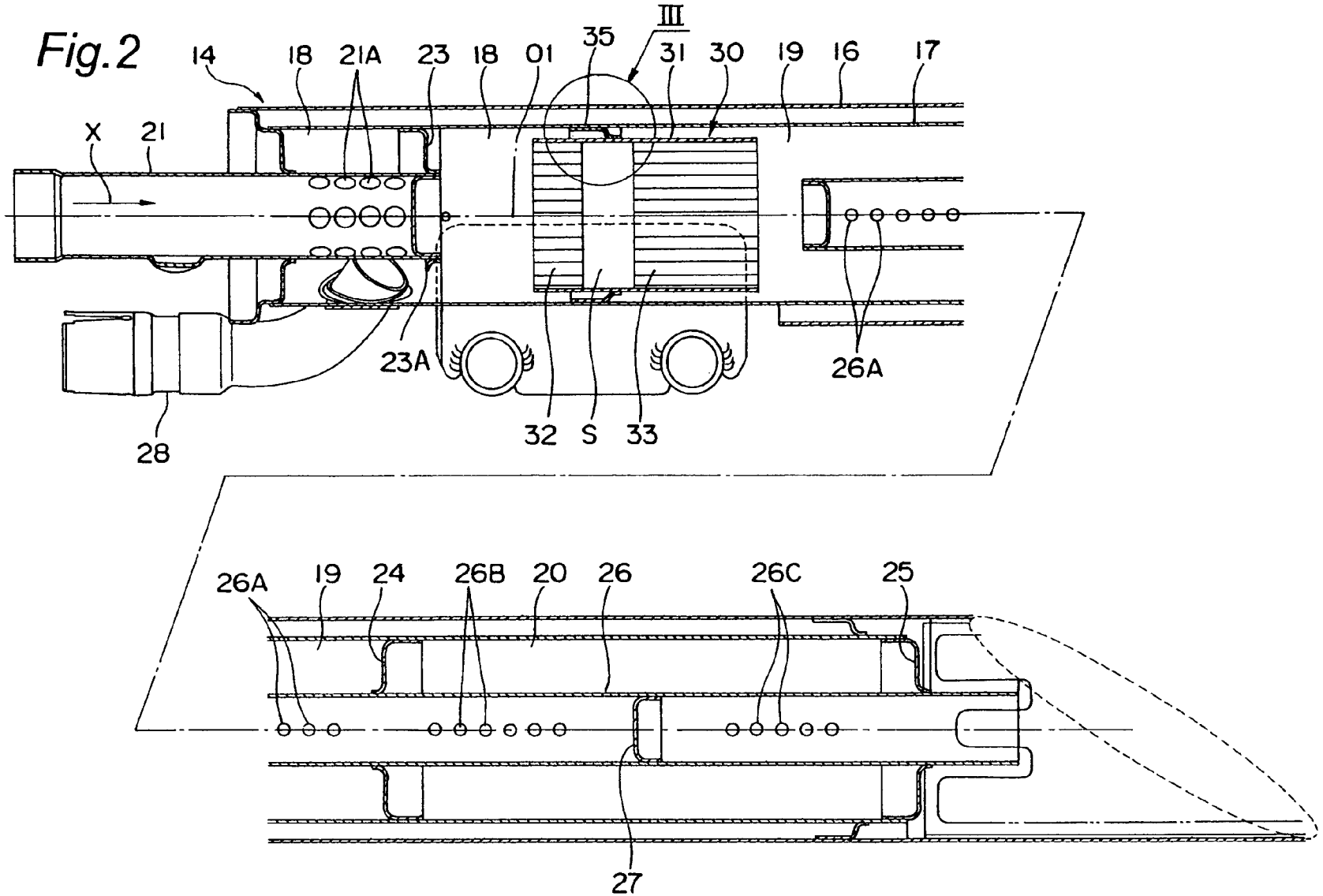
FIG. 2 is an enlarged sectional view of the exhaust pipe of FIG. 1.

FIG. 2 is an enlarged sectional view of a muffler (second pipe portion) 14. An outer shell of the second pipe portion (the muffler) 14 is formed of an outer cylinder body 16 and an inner cylinder body 17 (i.e. an exhaust pipe 17) disposed inside the outer cylinder body 16. Inside the inner cylinder body 17, a first expansion chamber 18, a second expansion chamber 19, and a third expansion chamber 20 are formed. The muffler 14 is disposed in a front-rear direction and exhaust gas flows front to rear in a direction X in the muffler 14.

A coupling pipe body 21 is attached to the first expansion chamber 18. A front portion of the coupling pipe body 21 protrudes forward from the first expansion chamber 18 and is connected to the first pipe portion 13 (FIG. 1). A rear portion of the coupling pipe body 21 is supported on the inner cylinder body 17 through a support plate 23 and a large number of first circulation holes 21A are formed to penetrate an outer peripheral face of the rear portion. A plurality of openings 23A are formed in the support plate 23 in a circumferential direction. Therefore, the exhaust gas flowing from the first pipe portion 13 passes through the coupling pipe body 21, flows into the first expansion chamber 18 through the first circulation holes 21A, and flows behind the support plate 23 through the openings 23A in the support plate 23.

Between the first expansion chamber 18 and the second expansion chamber 19, a first partition 35 is provided. A catalyst 30 is provided in such a manner as to penetrate the first partition 35. The exhaust gas flows from the first expansion chamber 18 through the catalyst 30 into the second expansion chamber 19. The catalyst 30 will be described later.

Between the second expansion chamber 19 and the third expansion chamber 20, a second partition 24 is provided. A rear end portion of the third expansion chamber 20 is closed with a rear end wall 25. An intermediate pipe body 26 extending in the front-rear direction is provided to penetrate the second partition 24 and the rear end wall 25. In the third expansion chamber 20, the intermediate pipe body 26 is closed with a third partition 27. A plurality of second circulation holes 26A are formed in an outer peripheral face of the intermediate pipe body 26 positioned in front of the third partition 27 and in the second expansion chamber 19. A plurality of third circulation holes 26B are formed in the outer peripheral face of the intermediate pipe body 26 positioned in front of the third partition 27 and in the third expansion chamber 20. A plurality of fourth circulation holes 26C are formed in the outer peripheral face of the intermediate pipe body positioned behind the third partition 27 and in the third expansion chamber 20.

The exhaust gas that has flowed into the second expansion chamber 19 flows into the intermediate pipe body 26 through the second circulation holes 26A and flows into the third expansion chamber 20 through the third circulation holes 26B. Then, the exhaust gas flows into the intermediate pipe body 26 through the fourth circulation holes 26C and is emitted outside through a rear end opening of the intermediate pipe body 26.

As shown in FIG. 1, the two exhaust pipes 11 are connected to each other through a connecting pipe 28. Respective end portions of the connecting pipe 28 are connected to the first expansion chambers 18 in the mufflers 14 of the respective exhaust pipes 11 as shown in FIG. 2. In this way, the exhaust gas substantially uniformly flows into the two exhaust pipes 11.

As shown in FIG. 2, the catalyst 30 is formed of a cylindrical outer cylinder 31 and catalyst main bodies 32, 33 disposed in the outer cylinder 31. The outer cylinder 31 is made of metal such as stainless steel and is disposed with its-axial center O1 oriented in the front-rear direction (exhaust flowing direction X). The catalyst main bodies 32, 33 are formed by depositing catalyst metal on surfaces of honeycomb structures made of stainless steel or the like. The catalyst main bodies 32, 33 are secured to the outer cylinder 31 by brazing.

The two catalyst main bodies 32, 33 are arranged side by side along the direction of the axial center O1 (axial direction) of the outer cylinder 31 and a space S is formed between them. The catalyst main body 32 on the front side (upstream side of the exhaust flowing direction X) is formed to be shorter than the catalyst main body 33 on the rear side (downstream side). A front end of the front catalyst main body 32 is substantially aligned with a front end of the outer cylinder 31 and a rear end of the rear catalyst main body 33 is substantially aligned with a rear end of the outer cylinder 31.

Figure 3:
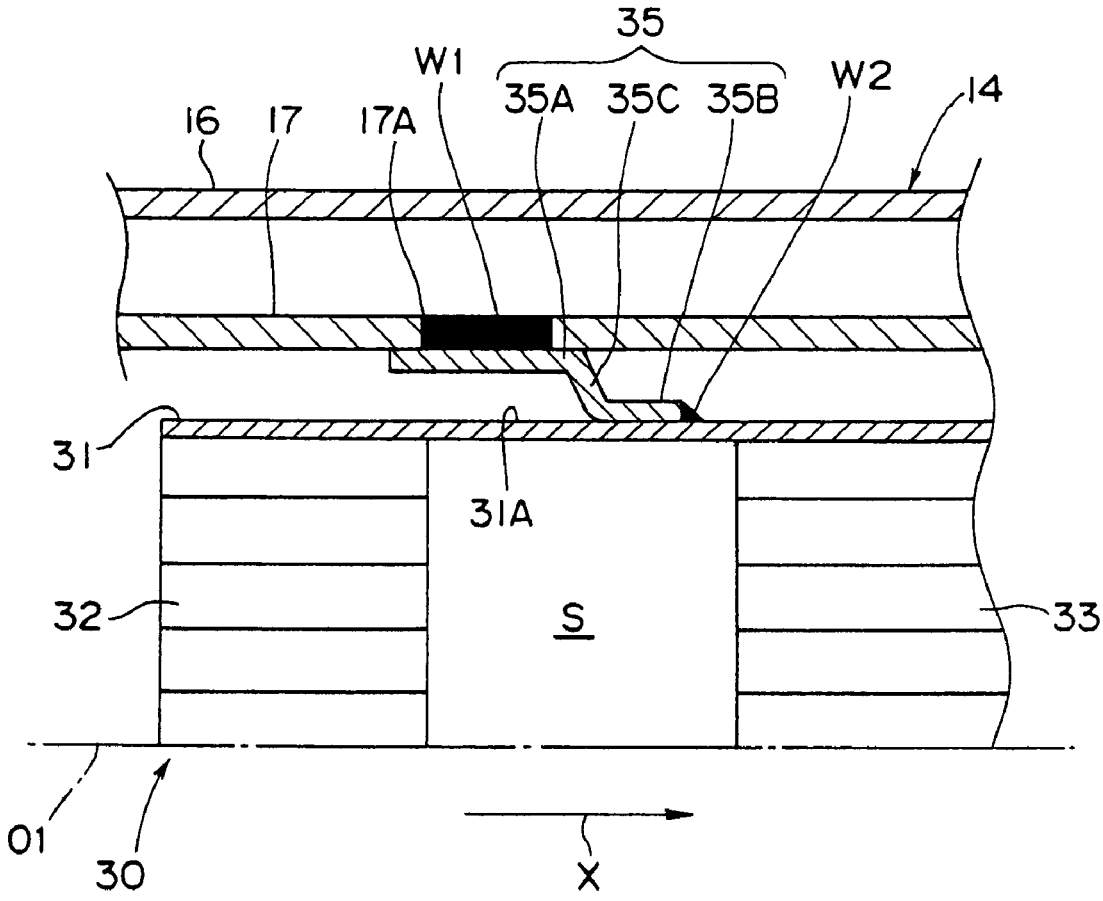
FIG. 3 is an enlarged sectional view of a fixed portion of a catalyst in the exhaust pipe (an enlarged sectional view of a part III in FIG. 2).

The catalyst 30 is fixed inside the muffler 14 through the first partition 35. In other words, the first partition 35 also functions as a mounting bracket for fixing the catalyst 30 to the muffler 14. FIG. 3 is an enlarged sectional view of a fixed portion of the catalyst 30. The first partition bracket (the mounting bracket) 35 is formed of an outer cylinder portion 35A disposed along an inner face of the inner cylinder body 17 of the muffler 14, an inner cylinder portion 35B disposed along an outer face of the outer cylinder 31 of the catalyst 30 and displaced at a position apart from the outer cylinder portion 35A in the direction of the axial center O1 and in a radial direction, and a connecting cylinder portion 35C inclined to connect adjacent end portions of the outer cylinder portion 35A and the inner cylinder portion 35B. The outer cylinder portion 35A, the inner cylinder portion 35B, and the connecting cylinder portion 35C are formed integrally.

A plurality of through holes 17A are formed in a portion of the inner cylinder body 17 which the outer cylinder portion 35A of the mounting bracket 35 overlaps. By applying plug welding W1 into the through holes 17A, the outer cylinder portion 35A is fixed to the inner face of the inner cylinder body 17.

The outer face of the outer cylinder 31 of the catalyst 30 is fixed to the rear end of the inner cylinder portion 35B of the mounting bracket 35 by fillet welding W2 in a plurality of positions in the circumferential direction. A portion (fixed face) 31A of the outer face of the outer cylinder 31 where the welding W2 is applied is positioned on an outer periphery side of the space S between the front and rear catalyst main bodies 32, 33.

Therefore, the present embodiment performs and exerts the following functions and effects.

(1) The space S is formed between the two catalyst main bodies 32, 33 and the portion (fixed face) 31A of the outer face of the outer cylinder 31 positioned on the outer periphery side of the space S is fixed to the inner face of the muffler 14 through the mounting bracket 35. Therefore, heat of welding W2 is less likely to be transferred to the brazed portion between the outer cylinder 31 and the catalyst main bodies 32, 33 and it is possible to reduce the influence of the heat on the brazed portion.

(2) Because the catalyst 30 is fixed to the muffler 14 through the mounting bracket 35, a shape of the catalyst 30 does not necessarily require to be adapted to an inside shape of the muffler 14 and the mounting bracket 35 is adaptable to the inside shape of the muffler 14. Therefore, the catalyst 30 can be fixed properly irrespective of the inside shape of the muffler 14.

(3) If one catalyst main body is provided in the outer cylinder as in the prior art, the exhaust gas flows through the same cell of the honeycomb from start to finish. Therefore, depending on temperature distribution, gas distribution, and the like in the catalyst main body, unevenness may develop in such a manner that purification is finished in one cell of the honeycomb while little progress has been made with purification in another cell of the honeycomb. In the catalyst 30 of the present embodiment, because the two catalyst main bodies 32, 33 are disposed with a clearance (space S) between them, the exhaust gas which has passed through the front catalyst main body 32 and has been purified is once mixed in the space S and then flows into the rear catalyst main body 33 and is purified again. Therefore, it is possible to purify the exhaust gas without causing unevenness by using the two catalyst main bodies 32, 33, thereby enhancing purification efficiency.

In general, in the outer cylinders of the same length, one of which is provided with one catalyst main body throughout the length of the outer cylinder and the other of which is provided with two catalyst main bodies 32, 33 with the space S between them will have substantially the same performance. Therefore, in the catalyst 30 of the present embodiment, it is possible to reduce amounts of the catalyst main bodies 32, 33 by an amount corresponding to the space S, thereby reducing the cost.

(4) Because the catalyst 30 is disposed in the front portion of the muffler 14, it is possible to circulate the exhaust gas of relatively high temperature, thereby promoting increase in temperature of the catalyst 30 so as to activate the catalyst 30.

(5) In the catalyst 30, because the front catalyst main body 32 is formed to be shorter than the rear catalyst main body 33, it is possible to further promote increase in temperature of the front catalyst main body 32 through which the exhaust gas of the higher temperature circulates to activate the catalyst main body 32, thereby enhancing the purification efficiency.

Figure 4:
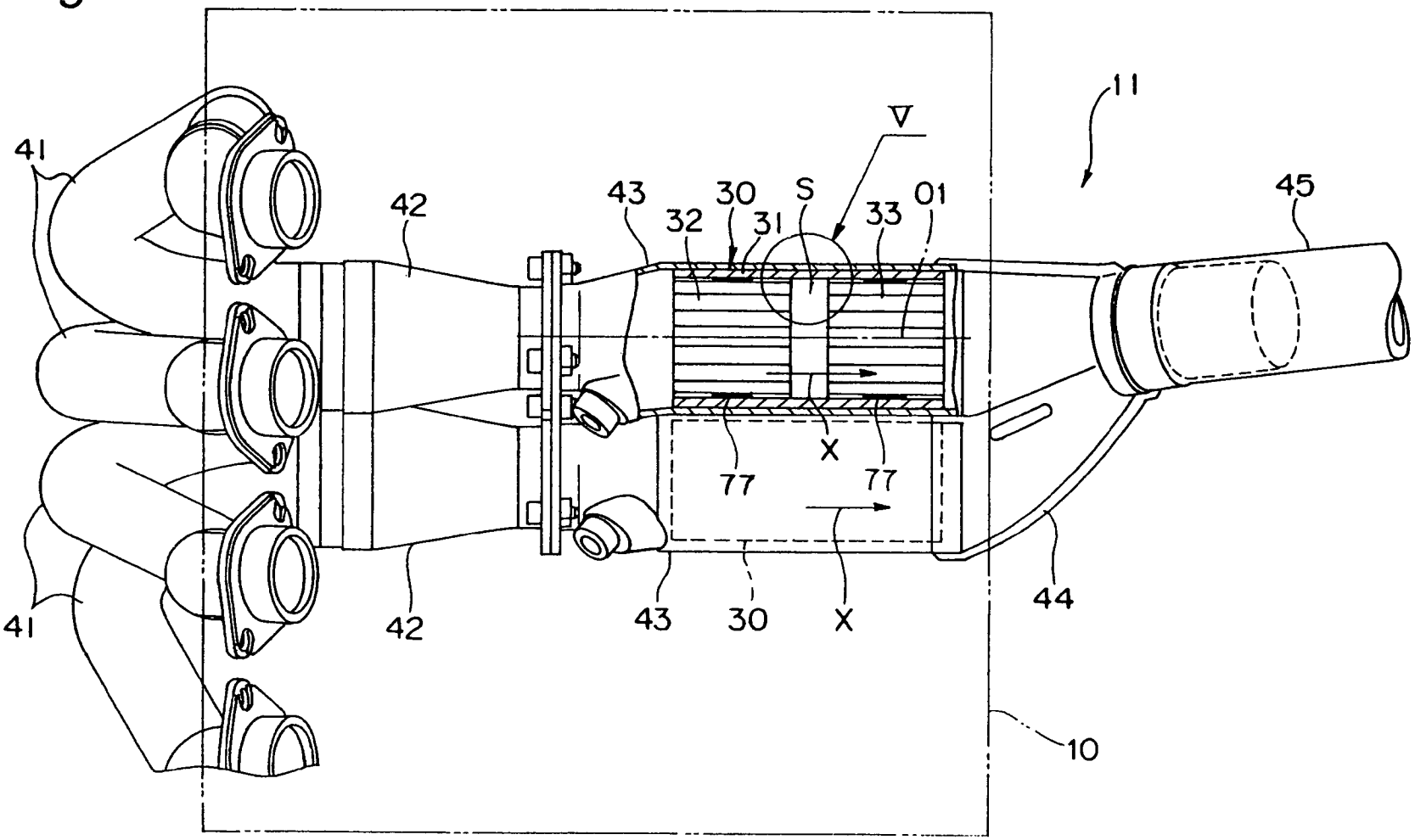
FIG. 4 is a plan view of an exhaust pipe according to a second embodiment of the present invention.

FIG. 4 is a plan view of a second embodiment of the present invention. Although the example in which the catalyst 30 is provided in the expansion chamber 19 of the muffler 14 has been shown in the first embodiment, an example in which the catalyst 30 is disposed in the exhaust pipe 11 before the muffler is shown in the present embodiment. An exhaust pipe 11 of the present embodiment is used for a parallel four-cylinder engine 10 and includes four first pipe portions 41 connected to exhaust ports of respective cylinders of the engine 10, two first collecting pipes 42 for collecting four of the first pipe portions 41 into two, two catalyst pipes 43 connected to the respective first collecting pipes 42, a second collecting pipe 44 for collecting the two catalyst pipes 43 into one, and a second pipe portion 45 connected to the second collecting pipe 44. A branch pipe, a muffler, and the like (not shown) are connected to the second pipe portion 45.

A catalyst 30 is disposed in each of the catalyst pipes 43. The catalyst 30 of the present embodiment is also formed of an outer cylinder 31 and two catalyst main bodies 32, 33 provided in the outer cylinder 31. However, two catalyst main bodies 32, 33 have substantially the same length and a space S is formed in a central portion in an axial direction of the outer cylinder 31. The respective catalyst main bodies 32, 33 are brazed to the outer cylinder 31 through brazing foils 77 disposed at substantially central portions of outer peripheral faces of the catalyst main bodies 32, 33 in the direction of the axial center O1.

Figure 5:
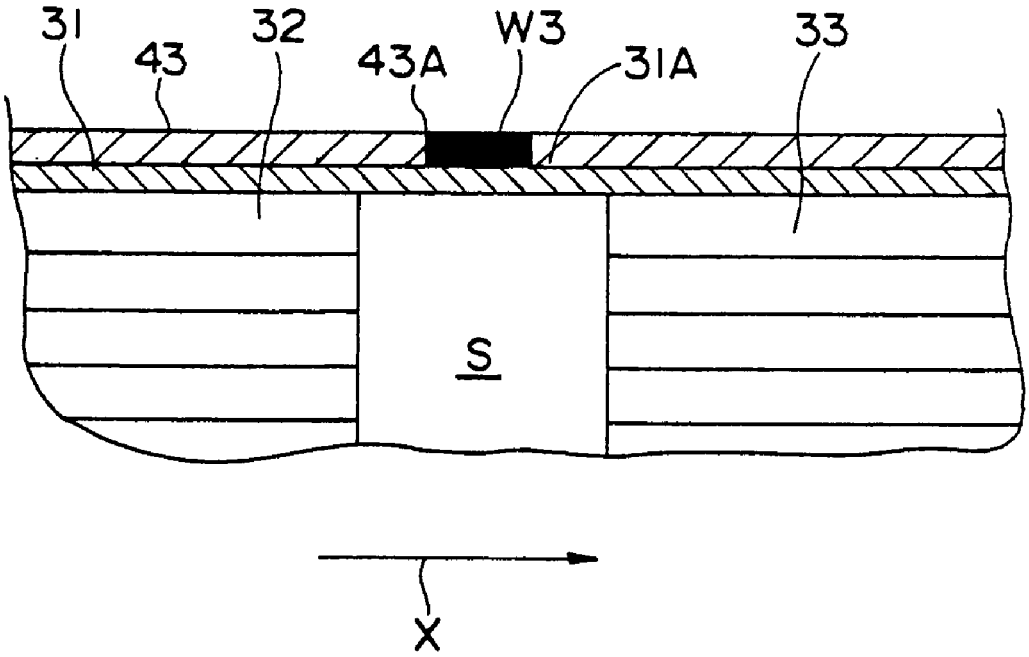
FIG. 5 is an enlarged sectional view of a fixed portion of a catalyst in the exhaust pipe (an enlarged sectional view of a part V in FIG. 4).

FIG. 5 is an enlarged sectional view of a fixed portion of the catalyst 30. The mounting bracket 35 as used in the first embodiment (FIG. 2) is not used in the present embodiment and the catalyst 30 is directly mounted to the exhaust pipe (catalyst pipe 43). A portion 31A of an outer face of the outer cylinder 31 positioned on the outer periphery side of the space portion S of the catalyst 30 is used as a fixed face of the outer cylinder 31 as in the first embodiment and a plurality of through holes 43A are formed in a plurality of positions in a circumferential direction of the catalyst pipe 43 in contact with the fixed face. The catalyst 30 is fixed to the catalyst pipe 43 by applying plug welding W3 into the through holes 43A. Therefore, the present embodiment also performs and exerts the same functions and effects as the first embodiment.

Figure 6:
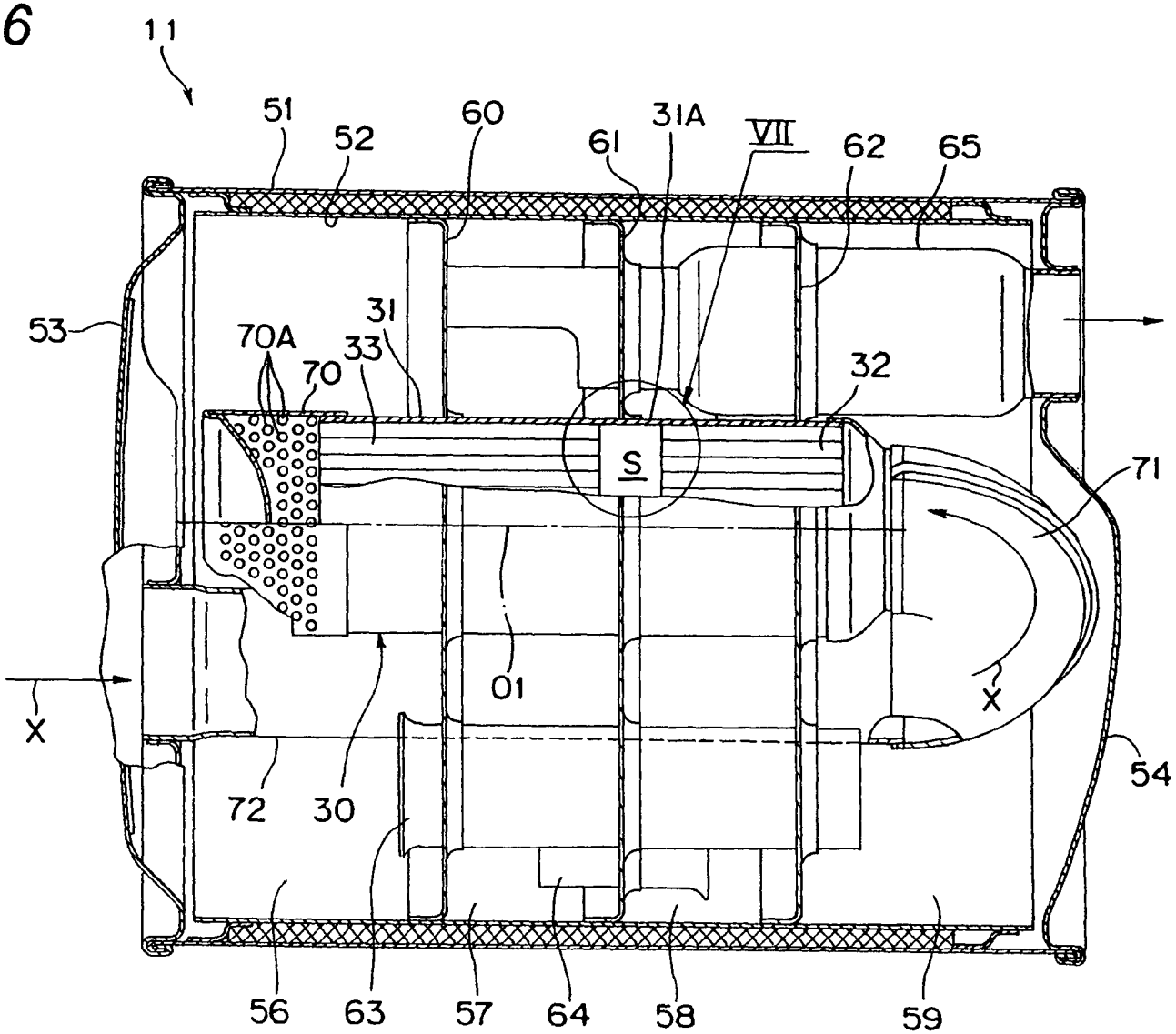
FIG. 6 is a sectional view of an exhaust pipe according to a third embodiment of the present invention.

FIG. 6 is a sectional view of an exhaust pipe 11 according to a third embodiment of the present invention. The exhaust pipe 11 of the present embodiment is a muffler having expansion chambers and a catalyst 30 is provided in this muffler 11. An outer shell of the exhaust pipe (the muffler) 11 is formed of an outer cylinder body 51 and an inner cylinder body 52 and opposite ends of the outer cylinder body 51 in a direction of an axial center are closed with a front end wall 53 and a rear end wall 54. Inside the inner cylinder body 52, a first expansion chamber 56, a fourth expansion chamber 57, a third expansion chamber 58, and a second expansion chamber 59 are disposed in this order from front and the respective expansion chambers 56, 57, 58, and 59 are separated by first, second, and third partitions 60, 61, and 62.

A first communicating pipe 63 for communicating with the first expansion chamber 56 and the second expansion chamber 59 penetrates the first, second, and third partitions 60, 61, and 62. A second communicating pipe 64 for communicating with the third expansion chamber 58 and the fourth expansion chamber 57 penetrates the second partition 61. Moreover, a discharge pipe 65 penetrates the second and third partitions 61, 62, and the rear end wall 54. An end portion of the discharge pipe 65 opens in the fourth expansion chamber 57 and the other end portion opens in the rear end wall 54. The third partition 62 is formed with a communicating hole (not shown) for communicating with the second expansion chamber 59 and the third expansion chamber 58.

A catalyst 30 is provided in the inner cylinder body 52. The catalyst 30 is provided in such a manner as to penetrate the first, second, and third partitions 60, 61, and 62 and is directly supported by the partitions 61, 62, and 63. One end portion of the catalyst 30 is disposed in the first expansion chamber 56. A delivery pipe 70 having a large number of circulation holes 70A on an outer peripheral face thereof is mounted to the one end portion of the catalyst 30. The other end portion of the catalyst 30 is disposed in the second expansion chamber 59 and one end of a curved pipe 71 curved into a U shape is connected to the other end portion. The other end of the curved pipe 71 is connected to an inflow pipe 72. The inflow pipe 72 is provided in such a manner as to penetrate the front end wall 53, the first, second, and third partitions 60, 61, and 62.

Into the muffler 11 of the present embodiment, the exhaust gas flows from the one end of the inflow pipe 72. Then, the exhaust gas passes from the curved pipe 71 through the catalyst 30 and flows into the first expansion chamber 56 through the circulation holes 70A in the delivery pipe 70. Then, the exhaust gas flows from the first expansion chamber 56 into the second expansion chamber 59 through the first communicating pipe 63, flows from the second expansion chamber 59 into the third expansion chamber 58 through the communicating hole (not shown), flows from the third expansion chamber 58 into the fourth expansion chamber 57 through the second communicating pipe 64, and is discharged outside from the fourth expansion chamber 57 through the discharge pipe 65.

The catalyst 30 is formed of an outer cylinder 31 and two catalyst main bodies 32, 33. Between the two catalyst main bodies 32, 33, a space S is formed. In this point, the embodiment is similar to the above-described first and second embodiments. The catalyst main body 32 on an upstream side of an exhaust flowing direction X is formed to be shorter than the catalyst main body 33 on the downstream side. A portion 31A of an outer face of the outer cylinder 31 positioned on an outer peripheral side of the space S between the two catalyst main bodies 32, 33 is used as a fixed face of the outer cylinder 31 and fixed to the second partition 61 by welding.

Figure 7:
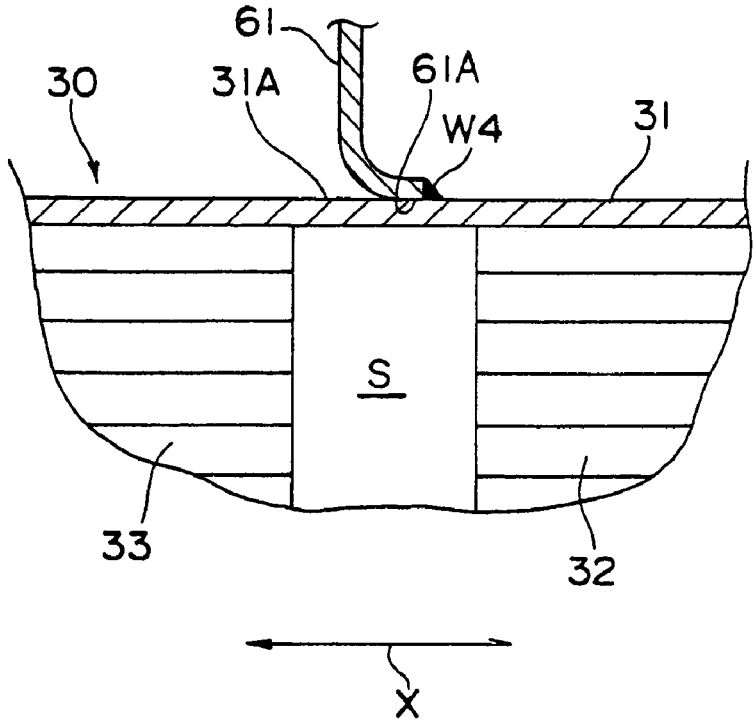
FIG. 7 is an enlarged sectional view of a fixed portion of a catalyst in the exhaust pipe (an enlarged sectional view of a part VII in FIG. 6).
Figure 8:
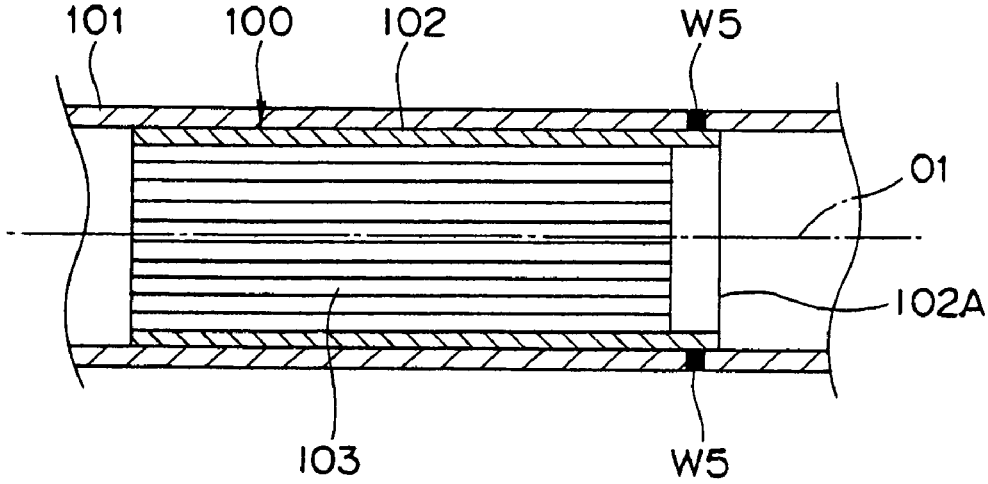
Fig. 8 (PRIOR ART)
FIG. 8 is a sectional view of a prior-art exhaust pipe.

FIG. 7 is an enlarged sectional view of a fixed portion of the catalyst 30. The outer cylinder 31 of the catalyst 30 penetrates a hole 61A formed in the second partition 61. A peripheral edge portion of the hole 61A is bent in the exhaust flowing direction X. The peripheral edge portion of the hole 61A and the portion (the fixed face) 31A of the outer face of the outer cylinder 31 are fixed to each other in a plurality of positions in a circumferential direction by welding W4.

The present embodiment also performs and exerts the same functions and effects as the first embodiment. By providing the catalyst 30 in such a manner that the catalyst 30 penetrates the partition 61 separating the plurality of expansion chambers in the muffler 11 as in the present embodiment, it is possible to fix the catalyst 30 by using the partition 61 as a mounting bracket.

(1) Although the two catalyst main bodies 32, 33 are provided in the outer cylinder 31 in the catalyst 30 in the above embodiments, three or more catalyst main bodies may be provided.

(2) The plurality of catalyst main bodies 32, 33 may have the same or different purification performance (such as size of cells of the honeycomb).

(3) The present invention can be utilized effectively as an exhaust purification device of vehicles such as a two-wheeled motor vehicle and a four-wheeled automobile, a working machine, industrial machine, or the like.

Although the invention has been described in its preferred embodiments with a certain degree of particularity, obviously many changes and variations are possible therein. It is therefore to be understood that the present invention may be practical otherwise than as specifically described herein with out departing from the scope and spirit thereof.

What is claimed is:

1. An exhaust purification device, comprising:

an exhaust pipe;

a catalyst disposed inside the exhaust pipe, the catalyst including (i) an outer cylinder, and (ii) a plurality of catalyst main bodies disposed inside the outer cylinder and directly attached to the outer cylinder, the plurality of catalyst main bodies including a first catalyst main body and a second catalyst main body; and a mounting bracket connecting the exhaust pipe to the outer cylinder, wherein the second catalyst main body is spaced apart from the first catalyst main body in an axial direction of the outer cylinder such that a mixing space is provided between the first catalyst main body and the second catalyst main body, wherein the catalyst is configured to allow an exhaust gas to flow therethrough in an exhaust gas flow direction, wherein a fixing portion of the outer cylinder is disposed directly radially outwardly of the mixing space in a radial direction of the outer cylinder, the fixing portion being a portion of the outer cylinder, and the radial direction of the outer cylinder being perpendicular to the exhaust gas flow direction, and wherein the mounting bracket is welded to the outer cylinder at the fixing portion such that a welded junction of the mounting bracket and the outer cylinder is directly above the mixing space in the radial direction of the outer cylinder.

2. An exhaust purification device according to claim 1, wherein the outer cylinder is arranged inside the exhaust pipe such that a longitudinal axis of the outer cylinder is parallel with a longitudinal axis of the exhaust pipe, and wherein the mounting bracket is disposed between the outer cylinder and the exhaust pipe.

3. An exhaust purification device according to claim 1, wherein the outer cylinder is arranged inside the exhaust pipe and the mounting bracket is disposed between the outer cylinder and the exhaust pipe.

4. An exhaust purification device according to claim 1, wherein the first catalyst main body is disposed upstream of the second catalyst main body, and wherein the first catalyst main body is shorter than the second catalyst main body in the axial direction of the outer cylinder.

5. An exhaust purification device according to claim 1, wherein the mounting bracket comprises:

an outer cylindrical bracket portion attached to an inner face of the exhaust pipe, an inner cylindrical bracket portion welded to the fixing portion of the outer cylinder, and a middle bracket portion connecting the outer cylindrical bracket portion to the inner cylindrical bracket portion.

6. An exhaust purification device according to claim 1, further comprising:

a first expansion chamber disposed inside of the exhaust pipe and upstream of the catalyst, and a second expansion chamber disposed inside of the exhaust pipe and downstream of the catalyst, wherein the mounting bracket partitions the first expansion chamber from the second expansion chamber such that exhaust gas flowing in the exhaust pipe between the first expansion chamber and the second expansion chamber is forced through the catalyst.

7. An exhaust purification device according to claim 1, wherein the mounting bracket is connected to the exhaust pipe at a connecting portion, the connecting portion being a portion of the exhaust pipe, and wherein the connecting portion of the exhaust pipe includes a plurality of through-holes for attaching the exhaust pipe to the mounting bracket.

8. An exhaust purification device according to claim 1, wherein the outer cylinder includes an inner face spaced apart from the outer face, and wherein the plurality of catalyst main bodies are attached to the inner face of the outer cylinder.

9. An exhaust purification device according to claim 8, wherein the plurality of catalyst main bodies are attached to the inner face of the outer cylinder by brazing.

10. An exhaust purification device, comprising:

an exhaust pipe;

a catalyst disposed inside the exhaust pipe, the catalyst including (i) an outer cylinder, and (ii) a plurality of catalyst main bodies disposed inside the outer cylinder and directly attached to the outer cylinder, the plurality of catalyst main bodies including a first catalyst main body and a second catalyst main body; and a mounting bracket connecting the exhaust pipe to the outer cylinder, wherein the second catalyst main body is spaced apart from the first catalyst main body in an axial direction of the outer cylinder such that a mixing space is provided between the first catalyst main body and the second catalyst main body, wherein the catalyst is configured to allow an exhaust gas to flow therethrough in an exhaust gas flow direction, wherein a fixing portion of the outer cylinder is disposed directly radially outwardly of the mixing space in a radial direction of the outer cylinder, the fixing portion being a portion of the outer cylinder, and the radial direction of the outer cylinder being perpendicular to the exhaust gas flow direction, and wherein the mounting bracket is connected to the outer cylinder at the fixing portion such that a junction of the mounting bracket and the outer cylinder is directly above the mixing space in the radial direction of the outer cylinder.

11. An exhaust purification device according to claim 10, wherein the outer cylinder is arranged inside the exhaust pipe such that a longitudinal axis of the outer cylinder is parallel with a longitudinal axis of the exhaust pipe, and wherein the mounting bracket is disposed between the outer cylinder and the exhaust pipe.

12. An exhaust purification device according to claim 10, wherein the outer cylinder is arranged inside the exhaust pipe and the mounting bracket is disposed between the outer cylinder and the exhaust pipe.

13. An exhaust purification device according to claim 10, wherein the first catalyst main body is disposed upstream of the second catalyst main body, and wherein the first catalyst main body is shorter than the second catalyst main body in the axial direction of the outer cylinder.

14. An exhaust purification device according to claim 10, wherein the mounting bracket comprises:

an outer cylindrical bracket portion attached to an inner face of the exhaust pipe, an inner cylindrical bracket portion welded to the fixing portion of the outer cylinder, and a middle bracket portion connecting the outer cylindrical bracket portion to the inner cylindrical bracket portion.

15. An exhaust purification device according to claim 10, further comprising:

a first expansion chamber disposed inside of the exhaust pipe and upstream of the catalyst, and a second expansion chamber disposed inside of the exhaust pipe and downstream of the catalyst, wherein the mounting bracket partitions the first expansion chamber from the second expansion chamber such that exhaust gas flowing in the exhaust pipe between the first expansion chamber and the second expansion chamber is forced through the catalyst.

16. An exhaust purification device according to claim 10, wherein the mounting bracket is connected to the exhaust pipe at a connecting portion, the connecting portion being a portion of the exhaust pipe, and wherein the connecting portion of the exhaust pipe includes a plurality of through-holes for attaching the exhaust pipe to the mounting bracket.

17. An exhaust purification device according to claim 10, wherein the outer cylinder includes an inner face spaced apart from the outer face, and wherein the plurality of catalyst main bodies are attached to the inner face of the outer cylinder.

18. An exhaust purification device according to claim 17, wherein the plurality of catalyst main bodies are attached to the inner face of the outer cylinder by brazing.

19. An exhaust purification device, comprising:

an exhaust pipe;

a catalyst disposed inside the exhaust pipe, the catalyst including (i) an outer cylinder, and (ii) a plurality of catalyst main bodies disposed inside the outer cylinder and directly attached to the outer cylinder, the plurality of catalyst main bodies including a first catalyst main body and a second catalyst main body;

a mounting bracket connecting the exhaust pipe to the outer cylinder;

a first expansion chamber disposed inside of the exhaust pipe and upstream of the catalyst;

a second expansion chamber disposed inside of the exhaust pipe and downstream of the catalyst;

wherein the second catalyst main body is spaced apart from the first catalyst main body in an axial direction of the outer cylinder such that a mixing space is provided between the first catalyst main body and the second catalyst main body, wherein the catalyst is configured to allow an exhaust gas to flow therethrough in an exhaust gas flow direction, wherein a fixing portion of the outer cylinder is disposed directly outwardly of the mixing space in a radial direction of the outer cylinder, the fixing portion being a portion of the outer cylinder, the radial direction of the outer cylinder being perpendicular to the exhaust gas flow direction, wherein the mounting bracket is welded to the outer cylinder at the fixing portion such that a welded junction of the mounting bracket and the outer cylinder is directly above the mixing space in the radial direction of the outer cylinder, wherein the mounting bracket partitions the first expansion chamber from the second expansion chamber such that exhaust gas flowing in the exhaust pipe between the first expansion chamber and the second expansion chamber is forced through the catalyst, wherein the first catalyst main body is disposed upstream of the second catalyst main body, and the first catalyst main body is shorter than the second catalyst main body in the axial direction of the outer cylinder, wherein the mounting bracket comprises:

(i) an outer cylindrical bracket portion attached to an inner face of the exhaust pipe, (ii) an inner cylindrical bracket portion welded to the fixing portion of the outer cylinder, and (iii) a middle bracket portion connecting the outer cylindrical bracket portion to the inner cylindrical bracket portion, wherein the mounting bracket is connected to the exhaust pipe at a connecting portion, the connecting portion being a portion of the exhaust pipe, wherein the connecting portion of the exhaust pipe includes a plurality of through-holes for aft aching the exhaust pipe to the mounting bracket, wherein the outer cylinder includes an inner face spaced apart from the outer face, and the plurality of catalyst main bodies are attached to the inner face of the outer cylinder by brazing, wherein the outer cylinder is arranged inside the exhaust pipe such that a longitudinal axis of the outer cylinder is parallel with a longitudinal axis of the exhaust pipe, and wherein the mounting bracket is disposed between the outer cylinder and the exhaust pipe.

* * * * *